US005884934A

United States Patent [19]

DeRocco et al.

[11] Patent Number: 5,884,934

[45] Date of Patent: Mar. 23, 1999

[54] SKI HAVING BINDING MOUNTING PORTION FOR ANGLED BOOT ORIENTATION

[75] Inventors: Anthony O. DeRocco, Seattle; Stephen D. Higgins, Port Orchard, both of Wash.

[73] Assignee: K-2 Corporation, Vashon, Wash.

[21] Appl. No.: 985,699

[22] Filed: Dec. 5, 1997

[51] Int. Cl.[6] ..... A63C 9/00

[52] U.S. Cl. ..... 280/607; 280/601; 280/609; 280/610

[58] Field of Search ..... 280/601, 607, 280/609, 610, 617, 636

[56] References Cited

U.S. PATENT DOCUMENTS

| | | |
|---|---|---|
| 3,844,576 | 10/1974 | Schultes . |
| 3,901,522 | 8/1975 | Boehm . |
| 4,293,142 | 10/1981 | Davignon . |
| 4,455,037 | 6/1984 | Pilpel et al. . |
| 4,498,686 | 2/1985 | Pilpel et al. . |
| 4,556,237 | 12/1985 | Meatto et al. . |
| 4,565,387 | 1/1986 | Feichtbauer . |
| 4,639,009 | 1/1987 | Meatto et al. . |
| 4,688,821 | 8/1987 | Meatto et al. . |
| 4,706,985 | 11/1987 | Meatto . |
| 4,987,282 | 1/1991 | Chastain . |
| 5,143,395 | 9/1992 | Mayr . |
| 5,188,386 | 2/1993 | Schweizer . |
| 5,232,241 | 8/1993 | Knott et al. . |
| 5,253,894 | 10/1993 | Thomas et al. . |
| 5,344,176 | 9/1994 | Trimble . |
| 5,346,244 | 9/1994 | Le Masson . |
| 5,413,371 | 5/1995 | Trimble . |
| 5,431,427 | 7/1995 | Pieber et al. . |
| 5,544,908 | 8/1996 | Fezio . |

*Primary Examiner*—D. Glenn Dayoan
*Assistant Examiner*—Clovia Hamilton
*Attorney, Agent, or Firm*—Christensen O'Connor Johnson & Kindness PLLC

[57] ABSTRACT

A ski has an elongate body with an upper surface and a binding mounting portion on the upper surface of the elongate body. The binding mounting portion has a front end and a rear end defining a boot support surface. The binding mounting portion has a first height at the front end and second height at the rear end with the second height being greater than the first height to dispose the boot support surface at an angle with the rear end higher than the front end of the boot support surface.

40 Claims, 2 Drawing Sheets

SKI HAVING BINDING MOUNTING PORTION FOR ANGLED BOOT ORIENTATION

FIELD OF THE INVENTION

The invention relates to boot and foot positioning on skis, and more specifically to positively angling a user's boot and foot on the binding mounting portion of a ski.

BACKGROUND OF THE INVENTION

Bindings are mounted on skis slightly rearward from center over the mid running surface of the ski. Skis have a tapered profile with the center portion being thicker, and the front and rear ends being thinner. Therefore, the ski is thinner under the rear of the binding mounting portion that supports the rear binding than it is under the front of the binding mounting portion where the toe binding is located. Thus, in conventional skis, ski boots attached thereto may be oriented at a negative ramp angle whereby the toe of the ski boot is angled upwardly with respect to, and is higher than, the heel portion of the boot. This ski boot orientation affects the mobility range of the ankle, restricting the ability of the hip to lower when the user attempts to maintain hip position just fore of the ankle joint. There is a point where the hip will "bottom out" prematurely in its downward motion. At this point, if the hip continues to lower, the center of mass falls aft of the ankle joint, resulting in an inefficient and out-of-balance stance. In contrast, if the ski boot, and foot, of the user is oriented such that the toe is lower than the heel on the ski, the user's ankle will have the ability to flex more effectively. This allows the hips and center of mass of the user to lower to a greater depth, while the hip joint remains directly forward of the ankle joint, resulting in the maximum effective vertical mobility range. In this manner, a well balanced and efficient position over the ski is achieved to optimize performance. The subject invention provides the above ski boot and foot orientation in order to maximally balance the stance of the skier. Women have relatively larger hips and a smaller upper body that shifts their center of gravity rearward. The subject invention, which provides a positive ramp angle, is thus especially beneficial to women.

SUMMARY OF THE INVENTION

A ski has an elongate body with an upper surface and a binding mounting portion on the upper surface of the elongate body. The binding mounting portion has a front end and a rear end defining a boot support surface. The binding mounting portion has a first height at the front end and second height at the rear end with the second height being greater than the first height to dispose the boot support surface at an angle with the rear end higher than the front end of the boot support surface.

Preferably, the elongate body of the ski has a core surrounded by a load carrying layer and the binding mounting portion has a core that is located on the load carrying layer of the elongate body. The core of the elongate body and the core of the binding mounting portion are preferably comprised of wood, laminated wood or polyurathane foam. Most preferably, the core of the binding mounting portion or of the elongate body surrounds a fastener retention layer. The fastener retention layer can be comprised of an aluminum alloy such as titanal.

The height of the front end of the binding mounting portion does not extend above the upper surface of the ski body, and can be a depression lower than the upper surface of the ski body. The height of the rear end of the binding mounting portion without a binding fastener retention layer is preferably from about 0.1 inch to about 0.3 inch, and is most preferably about 0.2 inch. The boot support surface of the binding mounting portion is preferably disposed at an angle of from about 0.1 degrees to about 2.0 degrees with respect to horizontal, and is most preferably disposed at an angle of about 0.25 degrees.

With a fastener retention layer, the height of the rear end of the binding mounting portion is preferably from about 0.1 inch to about 0.7 inch, and is most preferably 0.4 inch. The boot support surface of the binding mounting portion is preferably disposed at an angle of from about 0.1 degrees to about 2.0 degrees with respect to horizontal, and most preferably 1.1 degrees.

The above configuration allows the boot of the user, and therefore the foot of the user, to be oriented at a positive ramp angle (i.e., heel higher than toe). The positive ramp angle affords the user's ankle the ability to flex more effectively, and allow the hip or center of mass to lower to a greater depth while the hip joint remains directly forward of the ankle joint, resulting in the maximum effective vertical mobility range.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
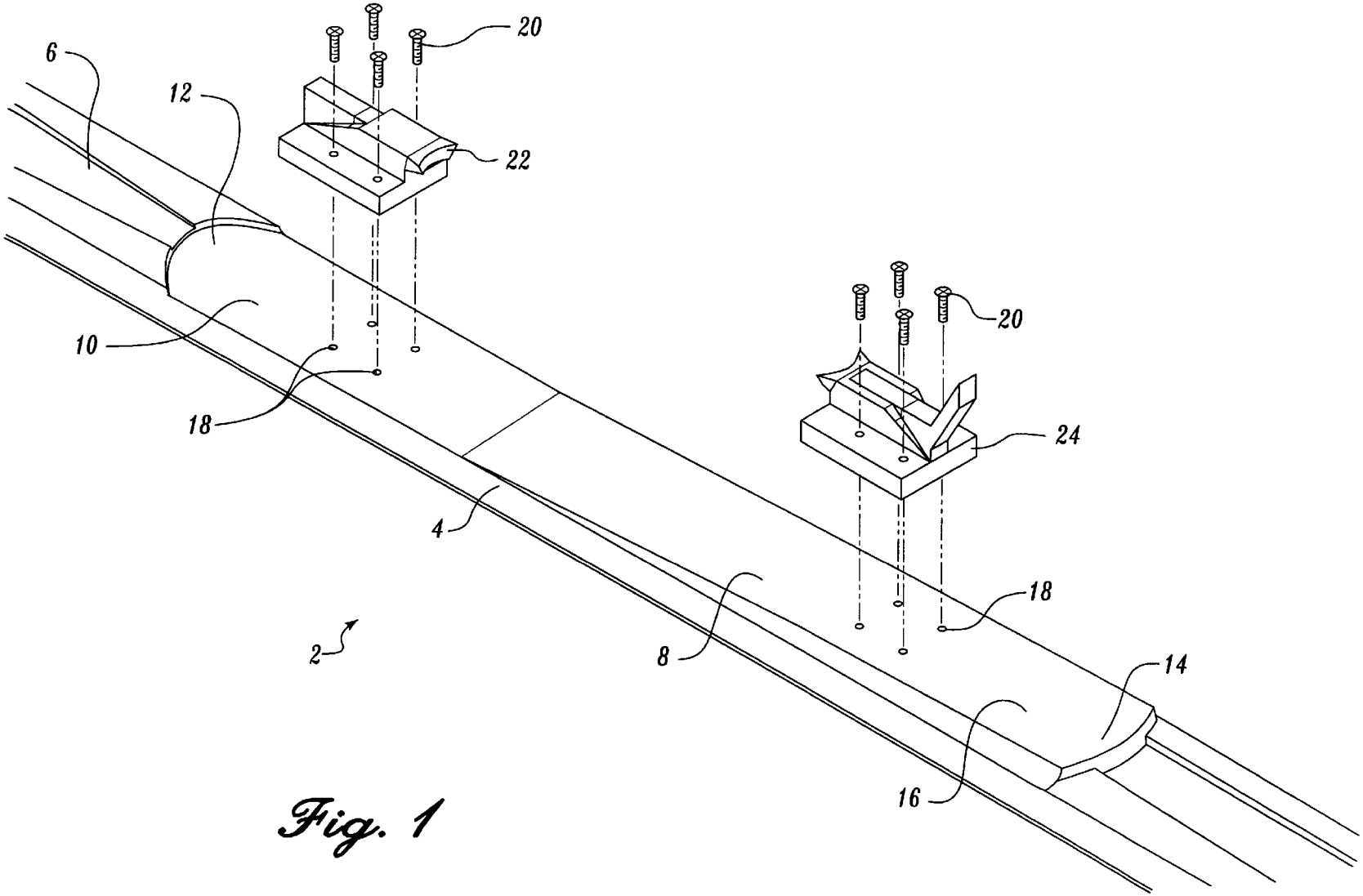
FIG. 1 is a perspective view of the portion of the ski of the present invention having the binding mounting portion thereon.
Figure 2:
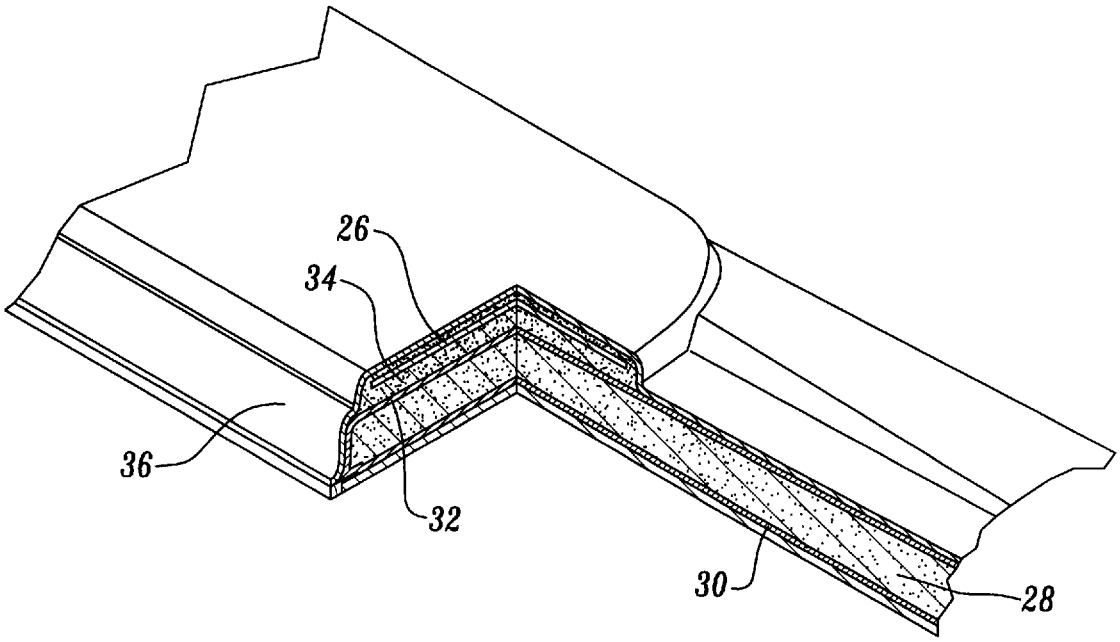
FIG. 2 is a detailed view of FIG. 1, partially exposed, showing the internal layers of the ski of the present invention.

Referring to FIGS. 1 and 2, ski 2 has an elongate body 4 with an upper surface 6. Binding mounting portion 8 is an elevated elongate portion located just rearward of the mid-running surface portion of ski 2. Binding mounting portion 8 has a front end 10 that does not extend above upper surface 6 of ski 2. As shown in FIG. 1, front end 10 includes depression 12 which is actually lower than upper surface 6 of ski 2 can also be flat. Binding mounting portion 8 has a rear end 14 that extends above upper surface 6 of elongate body 4 of ski 2 and thus extends a height greater than that of front end 10 of binding mounting portion 8. Boot support surface 16 is the upper surface of binding mounting portion 8 between front end 10 and rear end 14. The greater height of rear end 14 with respect to front end 10 thus disposes boot support surface 16 at an angle above horizontal such that a boot on boot support surface 16, and therefore the foot of a skier in the boot, is oriented at a positive ramp angle (i.e., heel higher than toe). Preferably, without a fastener retention layer the height of rear end 14 of binding mounting portion 8 is from about 0.1 to about and 0.3 inch, and is most preferably about 0.2 inch. Boot support surface 16 of binding mounting portion 8 is preferably disposed at an angle of from about 0.1 degrees to about 2.0 degrees with respect to horizontal, and is most preferably disposed at an angle of about 0.25 degrees. With a fastener retention layer, the height of rear end 14 of binding mounting portion 8 is between about 0.1 inch and 0.7 inch and is most preferably 0.4 inch; and boot support surface 16 of binding mounting portion 8 is preferably disposed at an angle from about 0.1 degree to about 2.0 degrees, and most preferably 1.1 degree from horizontal. Binding screw holes 18 pass through boot support surface 16 of boot mounting portion 8. Binding screws 20 are securable in binding screw holes 18 and attach toe binding 22 and heel binding 24 to boot support surface 16 of binding mounting portion 8. Binding screws 20 are secured in, or pass through, fastener retention layer 26 further described below. The above described positive ramp angle of a ski boot attached to toe binding 22 and heel binding 24 and located on boot support surface 16 of binding mounting portion 8 affords the user's ankle the ability to flex more effectively, and allows the hip or center of mass to lower to a greater depth while the hip joint remains directly forward of the ankle joint, thus resulting in the maximum effective vertical mobility range. In contrast, conventional skis have binding mounting portions that place the ski boot and user's foot in a negative ramp angle whereby the toe is angled upwardly with respect to, and is higher than, the heel. This ski boot orientation affects the mobility range of the ankle, restricting the ability of the hip to lower when the user attempts to maintain hip position just fore of the ankle joint. There is a point where the hip will "bottom out" prematurely in its downward motion. At this point, if the hip continues to lower, the center of mass falls aft of the ankle joint, resulting in an inefficient and out of balance stance.

Referring to FIG. 2, elongate body 4 is comprised of a core 28 and can be comprised of a foam material such as polyurathane. Alternatively, core 28 can be comprised of wood, or wood laminate. Surrounding core 28 of elongate body 4 are bottom load carrying layers 30 and top load carrying layers 32 that can be comprised of, for example, s glass, e glass or carbon. Binding mounting portion 8 includes a core 34 that can be comprised of a foam material such as polyurathane. Core 34 is generally configured as an elongate wedge, tapering in thickness from an aft end to a forward end. Alternatively, core 34 can be comprised of wood, or wood laminate. Core 34 is located on top load carrying layer 32 of elongate body 4 of ski 2. Exterior layer 36 surrounds core 34 of binding mounting portion 8 as well as bottom load carrying layers 30 and top load carrying layers 32 of elongate body 4 of ski 2. Exterior layer 36 can be comprised of, for example, urathane, and is a hardened surface layer that protects binding mounting portion 8 and elongate body 4 from the external environment.

As stated above, fastener retention layer 26 secures binding screws 24. As shown in FIG. 2, fastener retention layer 26 can be located within core 34 of binding mounting portion 8. It is to be understood, however, that the subject invention also encompasses locating fastener retention layer 26 within core 28 of elongate body 4. Fastener retention layer 26 has a density and strength greater than the density and strength of core 28 or core 34. Fastener retention layer 26 is preferably comprised of a sheet of metal, with the metal most preferably being an aluminum alloy such as titanal with a preferred thickness of about 0.05 inch. When the core in which fastener retention layer 26 is located (either core 28 of elongate body 4 or core 34 of binding mounting portion 8) is comprised of a foam material, fastener retention layer 26 preferably includes a plurality of openings through which core 28 or core 34 extends to further facilitate interconnection of fastener retention layer 26 and core 28 or core 34. When core 28 or core 32 is comprised of wood or wood laminate, a slot is located in core 28 or core 34 which receives fastener retention layer 26. The length of binding screws 20 employed is dependent upon whether fastener retention layer 26 is located in core 28 of elongate body 4 or core 34 of binding mounting portion 8.

Additionally, the subject invention encompasses an embodiment wherein fastener retention layer 26 is surrounded by either core 28 of elongate body 4 or core 34 of binding mounting portion 8, but binding mounting portion 8 is not angled, or ramped, but is instead substantially parallel to upper surface 6 of elongate body 4. Furthermore, it is to be noted that elongate body 4 and binding mounting portion 8 can be of either integral or modular construction.

While the preferred embodiment of the invention has been illustrated and described, it will be appreciated that various changes can be made therein without departing from the spirit and scope of the invention.

We claim:

1. A ski comprising:

an elongate body having an upper surface; and a binding mounting portion on said upper surface of said elongate body, said binding mounting portion having a front end and a rear end defining a boot support surface, said binding mounting portion having a first height at said front end and a second height at said rear end, said second height being greater than said first height to dispose said boot support surface at an angle with said rear end higher than said front end, said first height at said front end of said binding mounting portion not extending above said upper surface of said elongate body.

2. The ski of claim 1 wherein said elongate body and said binding mounting portion are integral.

3. The ski of claim 1 wherein said elongate body and said binding mounting portion are modular.

4. The ski of claim 1 wherein said elongate body has a core surrounded by a load carrying layer and said binding mounting portion has a core, said core of said binding mounting portion on said load carrying layer of said elongate body.

5. The ski of claim 4 wherein said core of said elongate body and said core of said binding mounting portion are comprised polyurathane.

6. The ski of claim 4 wherein at least one of said core of said binding mounting portion and said core of said elongate body surrounds a fastener retention layer.

7. The ski of claim 6 wherein said fastener retention layer is comprised of titanal.

8. The ski of claim 6 further comprising binding fastener means removably secured in said fastener retention layer.

9. The ski of claim 1 wherein said second height of said rear end of said binding mounting portion is between about 0.1 inch and about 0.3 inch.

10. The ski of claim 1 wherein said second height of said rear end of said binding mounting portion is about 0.2 inch.

11. The ski of claim 1 wherein said boot support surface of said binding mounting portion is disposed at an angle of from about 0.1° to about 2° with respect to horizontal.

12. The ski of claim 1 wherein said boot support surface of said binding mounting portion is disposed at an angle of about 0.25° with respect to horizontal.

13. The ski of claim 1 wherein said first height of said binding mounting portion is lower than said upper surface of said elongate body.

14. A ski comprising:

an elongate body having an upper surface; and a binding mounting portion on said upper surface of said elongate body, said binding mounting portion having a front end and a rear end defining a boot support surface, said binding mounting portion having a first height at said front end and a second height at said rear end, said second height being greater than said first height to dispose said boot support surface at an angle with said rear end higher than said front end, said elongate body having a core surrounded by a load carrying layer and said binding mounting portion having a core, said core of said binding mounting portion on said load carrying layer of said elongate body, said first height at said first end of said binding mounting portion not extending above said upper surface of said elongate body.

15. The ski of claim 14 wherein said elongate body and said binding mounting portion are integral.

16. The ski of claim 14 wherein said elongate body and said binding mounting portion are modular.

17. The ski of claim 14 wherein said core of said elongate body and said core of said binding mounting portion are comprised of materials selected from the group consisting of polyurathane.

18. The ski of claim 14 wherein at least one of said core of said binding mounting portion and said core of said elongate body surrounds a fastener binding retention layer.

19. The ski of claim 18 further comprising binding fastener means removably secured in said fastener retention layer.

20. The ski of claim 18 wherein said binding retention layer is comprised of titanal.

21. The ski of claim 14 wherein said second height of said rear end of said binding mounting portion is between about 0.1 inch and about 0.3 inch.

22. The ski of claim 14 said second height of said rear end of said binding mounting portion is about 0.2 inch.

23. The ski of claim 14 wherein said boot support surface of said binding mounting portion is disposed at an angle of from about 0.1° to about 2.0° with respect to horizontal.

24. The ski of claim 14 wherein said boot support surface of said binding mounting portion is disposed at an angle of about 0.25° with respect to horizontal.

25. A ski having an elongate body with an upper surface, said ski comprising:

a fastener retention layer for securely receiving binding fasteners at least partially therethrough;

a core extending above and below said fastener retention layer, said core having a density lower than that of said fastener retention layer; and a covering layer at least partially surrounding said core.

26. The ski of claim 25, wherein said core is in said elongate body and completely surrounds said retention layer.

27. The ski of claim 25, wherein said core comprises a foam material, said retention layer including openings through which said foam core extends.

28. The ski of claim 25, wherein said core comprises wood, said retention layer being sandwiched between portions of said wood core.

29. The ski of claim 25, wherein said retention layer comprises a sheet of metal.

30. The ski of claim 29, wherein said sheet comprises titanal.

31. The ski of claim 25, wherein said binding fasteners are standard binding screws and wherein said retention layer is positioned within said core, said core covering the top of said retention layer, said retention layer being close enough to the top of said core such that the standard binding screws extend through a portion of said core above said retention layer and at least partially into said retention layer.

32. The ski of claim 25 further comprising:

a binding mounting portion on said upper surface of said elongate body, said binding mounting portion having a front end and a rear end defining a boot support surface, said binding mounting portion having a first height at said front end and a second height at said rear end, said second height being greater than said first height to dispose said boot support surface at an angle with said rear end higher than said front end, said first height at said front end of said binding mounting portion not extending above said upper surface of said elongate body.

33. The ski of claim 32 wherein said elongate body and said binding mounting portion are integral.

34. The ski of claim 32 wherein said elongate body and said binding mounting portion are modular.

35. The ski of claim 32 wherein said core extending above and below said fastener retention layer is in said binding mounting portion.

36. The ski of claim 32 wherein said second height of said rear end of said binding mounting portion is between about 0.1 inch and about 0.3 inch.

37. The ski of claim 32 wherein said second height of said rear end of said binding mounting portion is about 0.2 inch.

38. The ski of claim 32 wherein said boot support surface of said binding mounting portion is disposed at an angle of from about 0.1° to about 2.0° with respect to horizontal.

39. The ski of claim 32 wherein said boot support surface of said binding mounting portion is disposed at an angle of about 0.25° with respect to horizontal.

40. The ski of claim 32 wherein said first height of said binding mounting portion is lower than said upper surface of said elongate body.

* * * * *

UNITED STATES PATENT AND TRADEMARK OFFICE

CERTIFICATE OF CORRECTION

PATENT NO. : 5,884,934
DATED : March 23, 1999
INVENTOR(S) : A.O. DeRocco et al.

It is certified that error appears in the above-identified patent and that said Letters Patent is hereby corrected as shown below:

| COLUMN | LINE | |
|---|---|---|
| [56] Pg. 1, col. 1 | Refs. Cited (U.S. Patents, Item 7) | "Feichtbauer" should read --Feichtlbauer-- |
| 4 (Claim 5, | 41 line 3) | "comprised polyurathane" should read --comprised of polyurethane-- |
| 5 (Claim 17, | 19 line 4) | "polyurathane" should read --polyurethane-- |
| 5 (Claim 22, | 31 line 1) | after "claim 14" insert --wherein-- |

Signed and Sealed this
Fourth Day of January, 2000

*Attest:*

*Attesting Officer*

*Acting Commissioner of Patents and Trademarks*